United States Patent [19]

Hänel et al.

[11] Patent Number: 4,730,469

[45] Date of Patent: Mar. 15, 1988

[54] LOCK WITH A LOCK CYLINDER FOR A FLOOR LID OF A MOTOR VEHICLE

[75] Inventors: Joachim Hänel, Böblingen; Fritz Häberle, Sindelfingen; Götz Mötting, Böblingen; Walter Münsinger, Böblingen-Dagersheim, all of Fed. Rep. of Germany

[73] Assignee: Daimler-Benz Aktiengesellschaft, Fed. Rep. of Germany

[21] Appl. No.: 905,928

[22] Filed: Sep. 10, 1986

[30] Foreign Application Priority Data

Sep. 10, 1985 [DE] Fed. Rep. of Germany ..... 3532151

[51] Int. Cl.[4] ..... E05B 65/44

[52] U.S. Cl. ..... 70/81; 70/162; 292/60; 292/198

[58] Field of Search ..... 70/78, 79, 80, 81, 83, 70/158–162; 292/198, 203, 60

[56] References Cited

U.S. PATENT DOCUMENTS 1,916,816 7/1933 Sprake ..... 292/198
3,584,483 6/1971 Orr ..... 70/81
4,494,781 1/1985 Lafosse ..... 292/60

FOREIGN PATENT DOCUMENTS 1256103 12/1967 Fed. Rep. of Germany .
1479476 3/1967 France .

*Primary Examiner*—Robert L. Wolfe
*Attorney, Agent, or Firm*—Barnes & Thornburg

[57] ABSTRACT

The application relates to a lock having a closing cylinder for a drop door of a motor vehicle, with the free end of the rotor being provided with a locking projection. To enable the drop door to be slammed shut even when the lock is closed, a ring is provided which can be turned through a certain angle about the rotor longitudinal axis against spring force and is mounted on the end of the rotor remote from the insertion opening for the key. A rotary latch body which is acted upon by a spring is coupled to the ring in hinged manner. The rotary latch body, in a base area, has a central passage opening for the free end of the rotor and a recess for the passage of the locking projection at a certain angular position. The rotary latch body has a projection with a bevelled side face which interacts as a mating piece with an inclined plane fixed to the vehicle to be movable against spring force when the door is slammed shut, to then be returned by the spring force to the locked position.

5 Claims, 3 Drawing Figures

LOCK WITH A LOCK CYLINDER FOR A FLOOR LID OF A MOTOR VEHICLE

BACKGROUND & SUMMARY OF THE INVENTION

The invention relates to a lock having a closing cylinder for a drop door of a motor vehicle, with the free end of the rotor being provided with a locking projection.

An object of the present invention is to develop a lock of this type with simple means in such a way that the drop door can be slammed shut even when the lock is closed.

This object is achieved in a lock of the above defined generic type in that a ring which can be turned through a certain angle about the rotor remote from the insertion opening for the key. A rotary latch body which is acted upon by a spring is coupled in hinged manner on the ring. The rotary latch body, in a base area, has a central passage opening for the free end of the rotor and a recess for the passage of the locking projection at a certain angular position. The rotary latch body has a projection with a bevelled side face which interacts as a mating piece with an inclined plane fixed to the vehicle.

To prevent fouling of the key insertion opening of the closing cylinder by loaded material and to conceal the presence of a lock, it is provided in an advantageous development of the invention that, in the constructional position, the upper side of the closing cylinder is covered by a handle used for opening the drop door.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
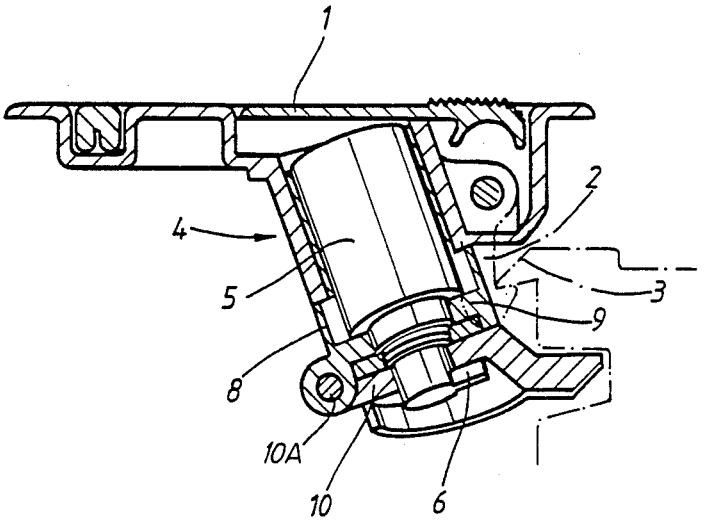
FIG. 1 is a schematic partial vertical sectional view through a lock developed according to the invention, with the drop door closed.
Figure 2:
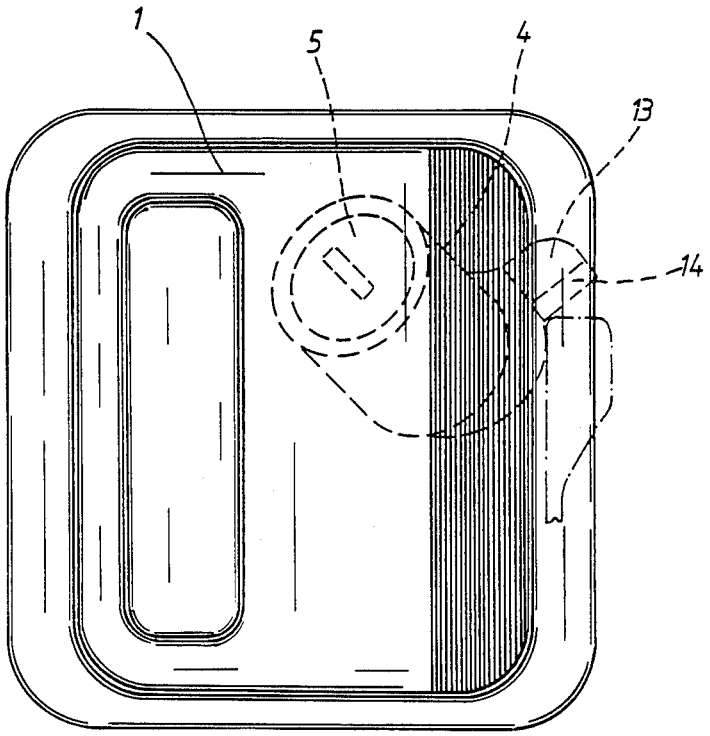
FIG. 2 shows a plan view of the representation according to FIG. 1.
Figure 3:
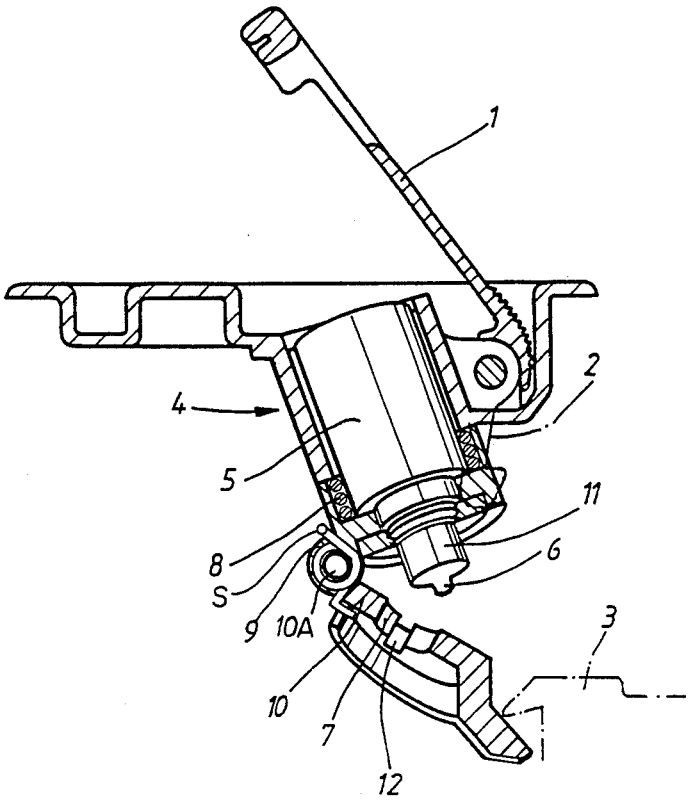
FIG. 3 shows the arrangement according to FIG. 1 during the door opening procedure.

A drop door (shown only partially) of a motor vehicle can be locked via a handle 1 and a locking hook 2 which is connected to the handle 1 in a manner which need not be described in greater detail here and interacts with a mating piece 3 fixed to the vehicle.

Provided in addition is a lock 4 having a closing cylinder or rotor 5 which is provided with a locking projection 6 at its free end. The upper side of the lock 4 is normally covered by the handle 1 and is therefore protected from fouling and from view.

A ring 9 which can be turned only through a certain angle about the rotor longitudinal axis against the force of a spring 8 is mounted on the end of the rotor 5, which end is remote from the insertion opening for the key. A rotary latch body 10, which is acted upon by a spring, is coupled in hinged manner on the ring 9.

Spring acting on latch body 10 pivots the same about pivot connection 10A toward the position depicted in FIG. 1. The base area of the rotary latch body 10 has a central passage opening 7 for the free end 11 of the rotor 5 and originating therefrom a recess 12 for the passage of the locking projection 6 at a certain angular position.

Finally, the rotary latch body 10 has a projection 13 with a bevelled side face 14. When the drop door is slammed shut when the lock 4 is closed, the rotary latch body 10, with its projection 13, runs against a mating projection fixed to the vehicle and the rotary latch body 10, because of the inclined plane, turns through about 45° about the rotor longitudinal axis. The rotary latch body 10 is then subsequently brought back into its initial position by the spring 8 and locking is effected after the door is fully closed.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Lock having a closing cylinder for a drop door of a motor vehicle, with a free end of a rotor being provided with a locking projection, characterized in that a ring which can be turned through a certain angle about the rotor longitudinal axis against spring force is mounted on the end of the rotor which is remote from the insertion opening for a key, on which ring a rotary latch body which is acted upon by a spring is coupled in hinged manner, which rotary latch body, in a base area, has a central passage opening for the free end of the rotor and a recess for the passage of the locking projection at a certain angular position, and that the rotary latch body has a projection with a bevelled side face which interacts as a mating piece with an inclined plane fixed to the vehicle.

2. Lock according to claim 1, characterized in that, in the constructional position, the upper side of the closing cylinder is covered by a handle used for opening the drop door.

3. A locking arrangement for a drop door of a motor vehicle comprising:

a locking rotor having a free end provided with a locking projection and an opposite end provided with a key insertion opening, a ring mounted on the end of the locking rotor remote from the key insertion opening, said ring being mounted for a predetermined range of angular rotational movement about the locking rotor longitudinal axis against ring spring means; and a rotary latch body springedly, hingedly coupled to the ring, said latch body exhibiting a base area with a central passage opening for the free end of the rotor and a recess for the passage of the locking projection at a certain angular position; said latch body further including a projection with a bevelled side face which is disposed to engage a fixed vehicle part during closing of the door with said locking rotor in locked position in such a manner that the latch body rotates the ring as the door closes and subsequently the ring spring means acts to restore the ring and latch body to a latching position.

4. An arrangement according to claim 3, wherein a handle covers the key insertion opening end of the rotor when said door is in a normal closed position.

5. An arrangement according to claim 3, wherein the ring spring means is a coil spring surrounding the rotor.

* * * * *